US006399015B1

(12) United States Patent
Dranger

(10) Patent No.: US 6,399,015 B1
(45) Date of Patent: Jun. 4, 2002

(54) METHOD FOR PRODUCING A FURNITURE ELEMENT AND SUCH AN ELEMENT

(76) Inventor: Jan Dranger, Carl Milles väg 7, Lidingö (SE), 181 34

( * ) Notice: Subject to any disclaimer, the term of this patent is extended or adjusted under 35 U.S.C. 154(b) by 0 days.

(21) Appl. No.: 09/147,409

(22) PCT Filed: Jun. 13, 1997

(86) PCT No.: PCT/SE97/01047

§ 371 (c)(1),
(2), (4) Date: Jan. 28, 1999

(87) PCT Pub. No.: WO97/48313

PCT Pub. Date: Dec. 24, 1997

(30) Foreign Application Priority Data

Jun. 19, 1996 (SE) ..... 9602430

(51) Int. Cl.[7] ..... B29C 49/18

(52) U.S. Cl. ..... 264/529; 264/531; 264/534; 264/535

(58) Field of Search ..... 264/529, 531, 264/534, 545; 428/35.2, 35.4, 35.5, 35.7, 36.92

(56) References Cited

U.S. PATENT DOCUMENTS 3,242,245 A * 3/1966 Grieg et al. ..... 264/545
3,358,062 A * 12/1967 Lemelson ..... 264/96
3,452,125 A 6/1969 Schurman et al. ..... 264/89
3,690,803 A 9/1972 Pechtold et al. ..... 425/326
3,935,358 A * 1/1976 Wyeth et al. ..... 428/166
4,070,430 A * 1/1978 Confer ..... 264/98
4,123,217 A 10/1978 Fischer et al. ..... 425/525
4,423,000 A * 12/1983 Teraoka ..... 264/524
4,891,000 A 1/1990 Ishii ..... 425/522

FOREIGN PATENT DOCUMENTS

WO WO96/02168 2/1996

* cited by examiner

*Primary Examiner*—Suzanne E. McDowell
(74) *Attorney, Agent, or Firm*—Jacobson Holman, PLLC

(57) ABSTRACT

The method of manufacturing an explainable element for use as a support body of a piece of furniture or a part thereof, a mattress, a cushion or the like. The element was a thin wall of a soft, flexible polymeric material, by blow moulding in an essentially closed form. During the blow-moulding process at least one portion of the wall of the element is pressed inwardly to a position where it is brought to permanently adhere to another portion of the wall of the element or another portion of the wall which is pressed inwardly.

27 Claims, 3 Drawing Sheets

METHOD FOR PRODUCING A FURNITURE ELEMENT AND SUCH AN ELEMENT

Figure 1:
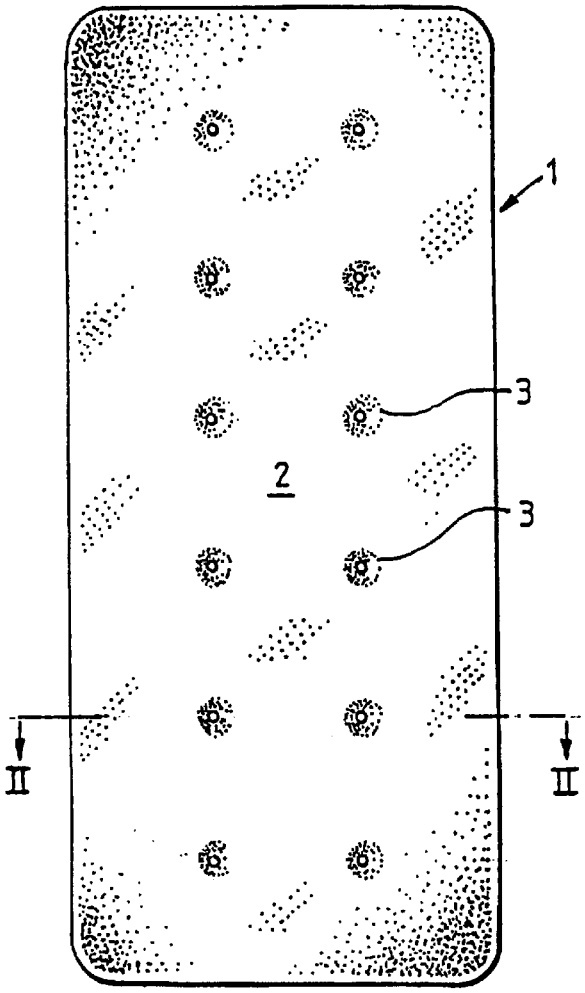

This invention concerns a method for producing a furniture element and an element which is produced by such a method.

A method of this kind is previously known from WO 96/02168 (Dranger). This method is well suited for producing elements having similar extensions in at least two dimensions. Production of more plate-like elements, such as for example elements formed as a cushion or a mattress, however, result in an unwanted convexity of the largest side walls. This result in practice in that mattresses, cushions etc. and support bodies which are extended in two dimensions have to be made from several elements which are placed inside a cover.

It is an aim of this invention to provide a blow-moulding process and elements produced in said process which eliminate this problem.

By such adhering or welding together of wall portions, a desired configuration of the walls of the element is achieved. The desired configuration is generally mainly even or repeatedly vaulted in accordance with a conventional upholstered mattress, cushion or the like. Also other configurations such as controlled curve-formed are however possible.

A main purpose of the invention is rational production in one single blow-moulding process of fillings or support bodies for pieces of furniture, beds, mattresses or elements such as cushions or pillows from a soft flexible thermoplastic material having a wall thickness of between about 0.5–1.5 mm. The dimensions in one plane of the elements is usually from about 2 m×2 m and smaller and the expanded resulting elements have thicknesses between about 5 cm and 25 cm.

The resulting construction having meeting portions forming wells or ditches from at least one side also prevents pressure on one part of the element from displacing air which expands the element in another part. The support structure therefore is experienced as stable also with changed load. A further advantage associated thereto is that also the largest body weight will have sufficient support of air so as to avoid "bottom touch".

It may be mentioned that in normal use the resulting element is intended to be provided with a cover which protects against wear, giving increased working life, and also a ventilated air layer between the user and the element, so as to increase comfort.

Adhering or welding together of portions of the blow-moulded work-piece will be obtained by using pressuring means, whereby the use of rod-shaped means result in portions being more or less spot-wise welded together, whereby the portions may be distributed in a pattern over a larger surface of the element.

Larger parts of the resulting expandable element may be controlled with respect to their shape by the pressuring means having plate-shape, whereby for example pivot portions between parts of the elements are easily achieved.

By the method being carried out in a modular form it is easily achieved that a large number of form sizes may be obtained at a reduced price from a small number of form components.

The invention also concerns an element which is produced in a method, said element being intended to be used as a support structure of a piece of furniture or a part of a piece of furniture such as a mattress, a cushion or the like.

Figure 3B:
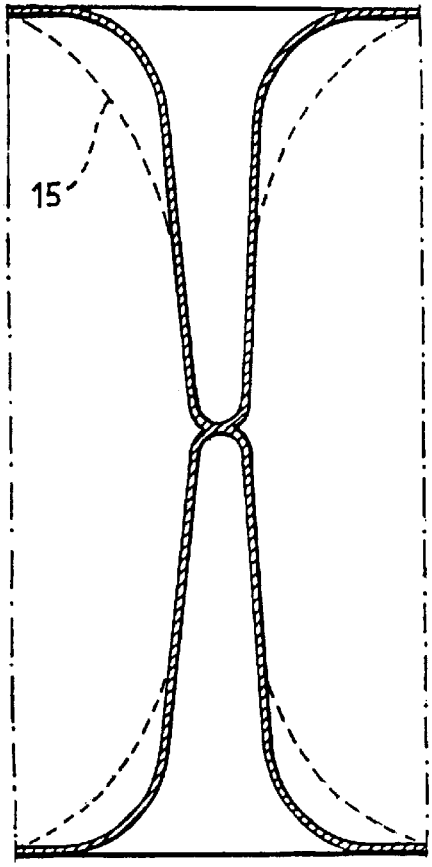
Figure 3A:
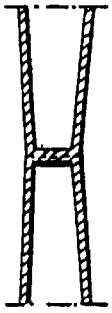
Figure 2:
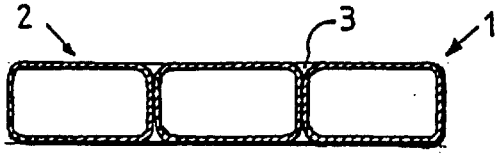
Figure 3C:
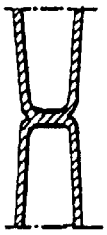
Figure 4:
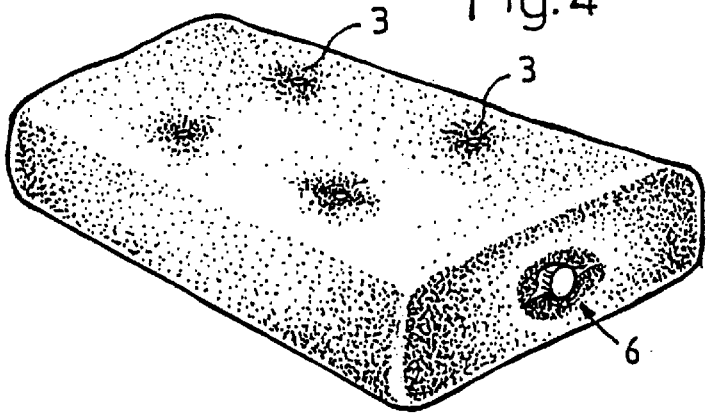
Figure 5:
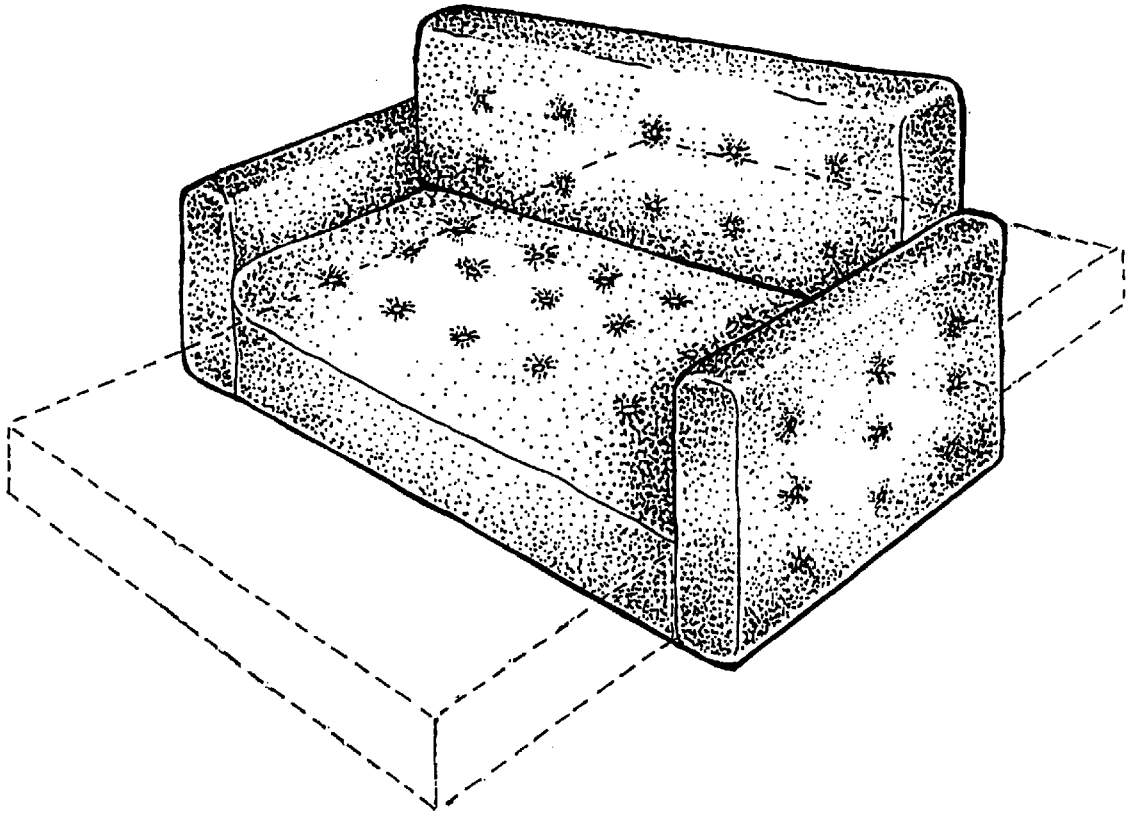
Figure 6:
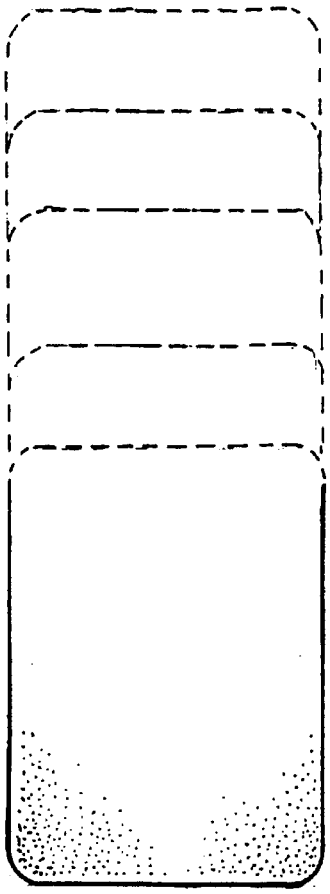
Figure 7:
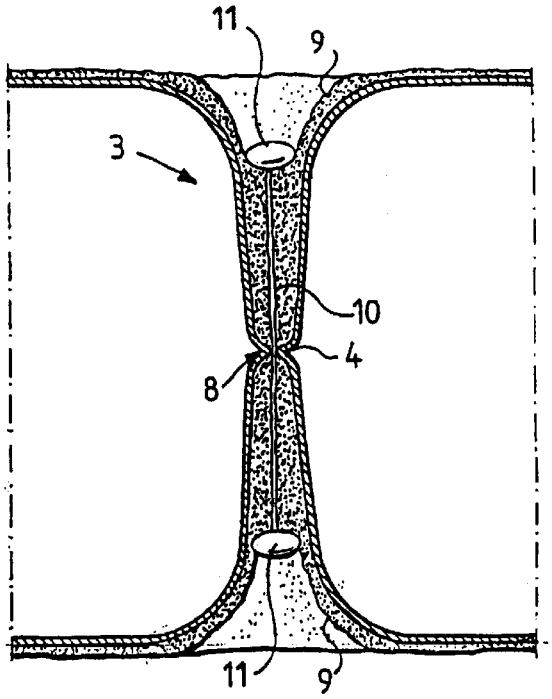
Figure 8:
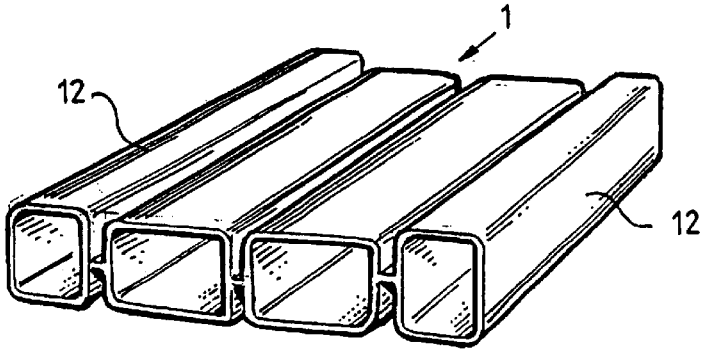

The invention will now be described in greater detail with reference to the annexed drawings, wherein:

FIG. 1 shows an element which is produced according to the invention in a plan view, FIG. 2 shows the element of FIG. 1 along the line I—I, FIGS. 3*a–c* show details of wall portions of the element according to FIG. 1 or 2 which are pressed together and welded together, FIG. 4 shows in a perspective view an element which is produced in accordance with the invention, FIG. 5 shows diagrammatically the use of elements which are manufactured according to the invention in a combination furniture item, FIG. 6 shows the principle of different sizes of elements resulting from modular forms, FIG. 7 shows a detail of an element having a perforated adhered portion, and FIG. 8 shows an element having an alternative shape.

FIG. 1 shows an expandable element 1, which results from a method according to the invention. The element is of a shape corresponding to a conventional mattress and is thus plate-shaped having two large opposite sides. Depressions 3 which are comprised of wall portions of the thin wall element are distributed over the shown upper surface 2, said depressions having been pressed inwardly during the manufacturing process such that most inwardly parts thereof are permanently adhered to or welded together with a corresponding pressed-in portion of the opposite wall.

The section of FIG. 2 illustrate the relatively extended configurations of the pressed-in portions at 3.

This is shown in more detail in FIGS. 3*a–c,* wherein rod-shaped pressuring means 15 are indicated with broken lines. The meeting surfaces of the pressed-in portions 3 are adhered or welded together at 4, which is achieved automatically when care is taken that the polymeric material of the work piece has sufficiently high temperature and that the distance between two meeting pressuring means 15 is adjusted such as to give a resulting pressuring force of a sufficient magnitude in this area. FIG. 3*b* indicates with broken lines at 15 an element having an essentially larger radius R in the area of outward opening of the "well".

In a blow-moulding process it is common to provide different parts of the form with different levels of cooling by having cooling channels for cooling liquids in the form walls. In order to assure that automatic welding will in fact result in the meeting points, the pressuring means are normally not heated, it is usually sufficient to reduce cooling of these means.

FIG. 3*a* shows an adhered portion where rod-shaped pressuring means 15 having essentially even end surfaces have been used whereas in FIG. 3 an embodiment is shown with the pressuring means having essentially part-spherical end surfaces. FIG. 3*c* shows an intermediate shape where the rod-shaped pressuring means 15 has been provided with round parts which are limited to the outer area of the end surface.

FIG. 4 shows a perspective view of an element which is manufactured in a method according to the invention, wherein also the air inlet opening is shown at 6. This part of the element corresponds to what is described in the above mentioned WO document.

The invention provides economically made elements having considerable extension which may be used as i.a. mattresses or support structures for sofas etc. FIG. 5 shows a combination furniture item which in full lines is a sofa and in broken lines is a bed. A cover which is normally used is not shown.

FIG. 6 shows how the size of elements which are manufactured according to the method may be varied when a modular form is used. Such a form comprises end portions including end wall parts as well as intermediate parts which may be inserted between the end parts and which may have different width either by consisting of a number of parts which may be fixed together or by fixed intermediate portions having different width. To this end FIG. 6 shows variations of dimensions of mattress-like elements resulting from manufacture in modular forms.

The use of suitable copolymers of polyolefins assures the softness and thus the comfort of the resulting furniture item and provides good properties with respect to tightness of the elements. These materials are easily recyclable in already existing recycling plants in many countries. The use of a copolymer including ethylene further provides low costs with respect to material as well as to manufacture.

By the copolymer including EMA (ethylene methyl acrylate), EBA (ethylene butyl acrylate), EVA (ethylene vinyl acetate) or EEA or EAA or the like, the resulting elements are rendered very good properties with respect to producability and softness, said properties being enhanced when EMA is present at 17–40% or more preferred at 20–30% or the most preferred at 24–26% with polyethylene or most preferred LDPE as the main constituent.

Addition of peroxide to the starting material is advantageous because of its effects with respect to manufacturing technique and since it essentially reduces "smell of plastic".

The starting material may also include a copolymer, which makes the starting material to be regarded as an elastomer. This way a more rubber-like appearance of the material will be obtained, which result in increased softness of the resulting element. An example of such a material include a styrene-butadien-styrene block copolymer and polyethylene HD and certain additives such as for example chalk, paraffin oil and a stabiliser.

The inlet opening of an element, which results from a manufacturing process of the invention is preferably of the kind which is described in the above WO document. The opening thus consist of a tube-shaped portion which extends from the bottom of a depression in for example an end wall of the element, whereby the opening dimension is between about 30 and 55 mm, such that it is adapted for indirect or direct co-operation with the blowing function of an ordinary hair dryer. This way the time for expanding the element is radically reduced. A further essential aspect is that it is possible to quickly empty the element from air after finished manufacture and for subsequent handling.

As to the shape of the blow-moulding form, the pressuring means may be arranged fixed in the respective form portion whereby final closing of the form in a chosen direction of displacement provides the above described pressing-in of the wall of the element and the subsequent welding. Alternatively the form may be provided with movable pressuring means, which after a partial expansion of the element is pressed through the wall of the form to the above described welding position, whereafter the final expansion will take place.

The distribution of wells and/or ditches is chosen by the person skilled in the art considering the desired thickness of the element.

The support element is preferably used together with textile covers which on the one hand protects the element from wear and on the other hand provides a ventilating layer between the elements and a user.

In a preferred embodiment the areas which are welded together are perforated as is shown in FIG. 7, thus allowing a more classical appearance of a mattress or a cushion and also allowing the fabric to be fastened to the element in a preferred manner. The fabric 9 is fastened by the thread 10 which leads through the perforation 8 and which on each side of the element 1 is provided with a button 11. The perforation may be achieved already in the forming process by the pressuring means centrally most outwardly being provided with portions which come into contact with each other. Possibly these portions are moveable for abutment when welding has been achieved. It is also possible to make the perforation in the finished element.

FIG. 8, finally, shows a preferred design of an element 1 such as a mattress, the outer portions 12 of which having a greater extension in the vertical direction in order to avoid that a user slides off the mattress in use.

What is claimed is:

1. A method of manufacturing an inflatable element for use as a support body of a piece of furniture or a part thereof, a mattress, or a cushion, said element having a thin wall of a soft, flexible polymeric material, formed by blow-moulding in an essentially closed form, wherein the method is carried out for production of a plate-like element, and during the blow-moulding process at least one portion of a wall on one of two largest opposing sides of the element is pressed inwardly by a pressing means to a position where the at least one portion of the wall is brought to permanently adhere to a portion of a wall of the other one of the two largest opposing sides of the element or another portion of the wall of the other one of the two largest opposing sides of the element which is pressed inwardly, and wherein the method is conducted in at least three steps, comprising:

a first step wherein a starting material having a starting shape is expanded to a part of a volume which is limited by the form, a second step including closing of the form whereby said pressing means is pressed inwardly into wall portions of a partially completed element, and a third step wherein the element is finally expanded to a final shape, so as to create meeting portions of opposing walls, ensuring that in use of the element unwanted partial expansion is restricted.

2. The method according to claim 1, wherein the pressing means is provided in the form.

3. The method according to claim 1, wherein the pressing means is comprised of a rod-shaped or plate-shaped element for making well-shaped or ditch-shaped depressions.

4. The method according to claim 1, wherein a copolymer of polyolefins is used as the starting material.

5. The method according to claim 4, wherein a copolymer including ethylene is used.

6. The method according to claim 5, wherein a copolymer including one of EMA, EVA, EBA, EEA and EAA is used.

7. The method according to claim 6, wherein the starting material is used containing EMA at 17–40% having polyethylene as a main constituent.

8. The method according to claim 7, wherein 20–30% of EMA is used.

9. The method according to claim 8, wherein 24–26% of EMA is used.

10. The method according to claim 7, wherein LDPE is used.

11. The method according to claim 4, wherein a peroxide is added to the starting material with a proportion of about 700–1700 PPM.

12. The method according to claim 11, wherein the proportion of peroxide is about 900–1100 PPM.

13. The method according to claim 1, wherein a copolymer rendering the material properties as an elastomer is included in the starting material.

14. The method according to claim 1, wherein the steps are carried out in a modular form to provide fixed end portions and changeable intermediate portions having different width to achieve variation of a form size with a limited number of components.

15. A method of manufacturing an inflatable element for use as a support body of a piece of furniture or a part thereof, a mattress, or a cushion, said element having a thin wall of a soft, flexible polymeric material, formed by blow-moulding in an essentially closed form, wherein the method is carried out for production of a plate-like element, and during the blow-moulding process at least one portion of a wall on one of two largest opposing sides of the element is pressed inwardly to a position where the at least one portion of the wall is brought, in an adhering position, to permanently adhere to a portion of a wall of the other one of the two largest opposing sides of the element or another portion of the wall of the other one of the two largest opposing sides of the element which is pressed inwardly, and wherein movable pressing means, which are arranged in the closed form, after a partial expansion of the element is pressed through the wall of the closed form to the adhering position, whereupon the final expansion takes place, so as to create meeting portions of the two largest opposing walls, ensuring that in use of the element unwanted partial expansion is restricted.

16. The method according to claim 15, wherein the movable pressing means is comprised of a rod-shaped or plate-shaped element for making well-shaped or ditch-shaped depressions.

17. The method according to claim 15, wherein a copolymer of polyolefins is used as a starting material.

18. The method according to claim 17, wherein a copolymer including ethylene is used as the starting material.

19. The method according to claim 18, wherein a copolymer including one of EMA, EVA, EBA, EEA and EAA is used.

20. The method according to claim 19, wherein the starting material is used containing EMA at 17–40% having polyethylene as a main constituent.

21. The method according to claim 20, wherein 20–30% of EMA is used.

22. The method according to claim 21, wherein 24–26% of EMA is used.

23. The method according to claim 20, wherein LDPE is used.

24. The method according to claim 17, wherein a peroxide is added to the starting material with a proportion of about 700–1700 PPM.

25. The method according to claim 24, wherein the proportion of peroxide is about 900–1100 PPM.

26. The method according to claim 17, wherein a copolymer rendering the material properties as an elastomer is included in the starting material.

27. The method according to claim 15, wherein the final expansion is carried out in a modular form which provides fixed end portions and changeable intermediate portions having different width to achieve variation of a form size with a limited number of components.

* * * * *